United States Patent [19]

Wesley

[11] 4,111,737

[45] Sep. 5, 1978

[54] APPARATUS FOR LABELING SHEETING ROLLS

[75] Inventor: John G. Wesley, Berwyn, Ill.

[73] Assignee: Labelette Company, Forest Park, Ill.

[21] Appl. No.: 688,368

[22] Filed: May 20, 1976

[51] Int. Cl.[2] ..... B65H 81/00

[52] U.S. Cl. ..... 156/458; 156/187; 156/215; 156/475

[58] Field of Search ..... 156/187, 446, 457, 458, 156/475, 215; 53/211, 214; 214/1 PB, 1 P, DIG. 3

[56] References Cited

U.S. PATENT DOCUMENTS

| | | | |
|---|---|---|---|
| 1,640,050 | 8/1927 | Nicholas | 156/446 X |
| 3,072,980 | 1/1963 | Ewing | 214/1 PB X |
| 3,278,359 | 10/1966 | Wesley | 156/351 |
| 3,494,095 | 2/1970 | Valvano | 53/214 X |
| 3,618,741 | 11/1971 | Berndt | 214/1 PB X |

*Primary Examiner*—David A. Simmons

*Attorney, Agent, or Firm*—McWilliams & Mann

[57] ABSTRACT

A method and apparatus for labeling sheeting rolls specifically adapted for labeling wallpaper rolls of which the outer end edge of the sheet that is convoluted to form the roll is free of securement against the roll, wherein the roll is rolled along a runway leading to a labeling station, with the roll oriented to have its free outer end edge in trailing relation with respect to the direction of rotational movement of the roll, as it moves along the runway. At the labeling station the roll is supported by and between a pair of rollers, one of which is driven to rotate the roll for labeling purposes at a predetermined surface speed in the same direction of rotational movement as when the roll moves along the runway. The roll is labeled by feeding a label from a stack of labels and across a gluing roller at the surface speed of the roll, and rolling the label onto the rotating roll, after which the labeled roll is ejected from the labeling station by a kicker device and rolls down an exit ramp to a carry away conveyor.

2 Claims, 4 Drawing Figures

APPARATUS FOR LABELING SHEETING ROLLS

This invention relates to a method and apparatus for labeling sheeting rolls, and more particularly, to a method and apparatus for labeling wallpaper sheeting convoluted in roll form for display and sale purposes.

Wallpaper is commonly convoluted for display and sale purposes into roll form. As it is the decorative surfacing of the sheeting that the customer ordinarily will be most interested in inspecting (when deciding on his purchase), it is most important that as much of such surfacing as is reasonably practical be exposed for customer inspection purposes.

It is also necessary, of course, to have the individual rolls secured so that they will remain rolled up while they are being handled. This can, of course, be conveniently done by securing the outer end edge of the sheet in place against the side of the roll using adhesive tape or the like. However, this leaves for application to the roll by a separate label or wrapper the information the roll supplier may wish to have the roll bear for product end or manufacture identification purposes.

A principal object of the present invention is to provide a method and apparatus for labeling rolled wallpaper sheets in which only the label is required to hold the sheet in its rolled up relation, and the label is proportioned and positioned to permit maximum exposure of the sheeting decorative surfacing.

Other objects of the invention are to provide a method and apparatus for labeling rolled wallpaper sheets which avoids the need to secure the free outer end edge of the sheet against the roll prior to labeling, which accommodates labeling of the rolls on a mass production basis, and which effects wallpaper sheet roll labeling in an effective, efficient and economical manner.

In accordance with the invention, an apparatus for labeling wallpaper sheet rolls is provided comprising a runway along which individual rolls are rolled one by one, by an endless conveyor having one run of same engaging the upper sides of the rolls, with the rolls being oriented to have the roll-free outer end edge in trailing relation with respect to the direction of rotational movement of the individual rolls along the runway. The runway leads to a labeling station to which the rolls are supplied one by one, by the rolling action indicated. At the labeling station the individual rolls are supported on and between a pair of rollers, one of which is driven to rotate the roll at a predetermined surface rotational speed, and in the same direction of rotational movement as when the rolls are moved along the runway.

The rotating roll is labeled by employing a single label to be rolled around the roll with its ends overlapping and glued together to both label the roll and secure the roll free end in place. For this purpose the label is fed from a supply hopper, and at the surface speed of the roll, over a gluing roller that applies glue thereto, with the label then being fed under one of the rollers that is rotatably supporting a roll, which rolls the label onto the roll as the roll is rotated, and with the ends of the label being rolled and glued together in overlapping relation for firm retention of the roll in its rolled up relation.

The label is preferably applied adjacent one end of the roll and is proportioned lengthwise of the roll for maximum exposure of the decorative surfacing fo the roll.

After labeling the rolls are ejected from the labeling station to roll down an exit ramp onto a carry away conveyor that takes the individual rolls to a point of packaging and/or storage, as desired.

Other objects, uses, and advantages will be obvious or become apparent from a consideration of the following detailed description and the application drawings in which like reference numerals are employed throughout the several views.

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

GENERAL DESCRIPTION

Figure 4:
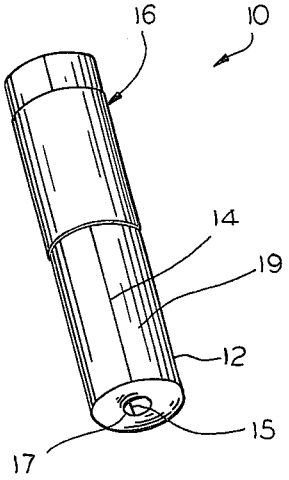
FIG. 4 is a perspective view diagrammatically illustrating a wallpaper sheeting roll labeled in accordance with the present invention.

Reference numeral 10 of FIG. 4 generally indicates a roll of wallpaper that is in the usual convoluted form and comprises an elongate sheet 12 having its edge 14 form the outer edge of the roll (the inner edge 15 lies along the bore 17 defined by the roll 10). It is assumed that the outwardly facing surfacing 19 of the sheet 12 is decorated to serve as the usual decorative wall surfacing of wallpaper.

In accordance with the present invention, a single label 16 is applied to the roll 10 to both secure the roll in its wound up relation as well as bear suitable identifying indicia for product and/or manufacture indentification purposes and the like. The roll in the form illustrated is applied to one end of the roll 10, and is proportioned so that the label will have its ends glued together in overlapping relation to secure the roll in its wound up relation and yet provide for maximum exposure of the roll decorative surface 19 for customer inspection purposes. While, of course, the label could be applied in any desired point along the length of the roll 10, applying the label adjacent one end of the roll provides for exposed surfacing of the roll to be of maximum continuous length, lengthwise of the roll.

Apparatus 18 generally comprises a suitable frame 20 including a hopper indicated at 22 forming a label supply station and equipped with a vertically movable platform or elevator 24 on which rests a stack 26 of the labels 16. The elevator 24 is arranged to be elevated automatically to maintain the topmost label 16 at a predetermined elevation in cooperation with a first stage feed roller device or mechanism 28 and label support and guide plate 29, which supply the labels one by one to a second stage feed roller device or mechanism 31 from which the labels are moved in timed sequence to a glue roller 33 that is arranged in accordance with my prior Patent No. 3,278,359 to apply glue to the individual labels as desired, and from which labels are fed by feed roller 30 about guide device 35 for application to the individual rolls 10.

Figure 1:
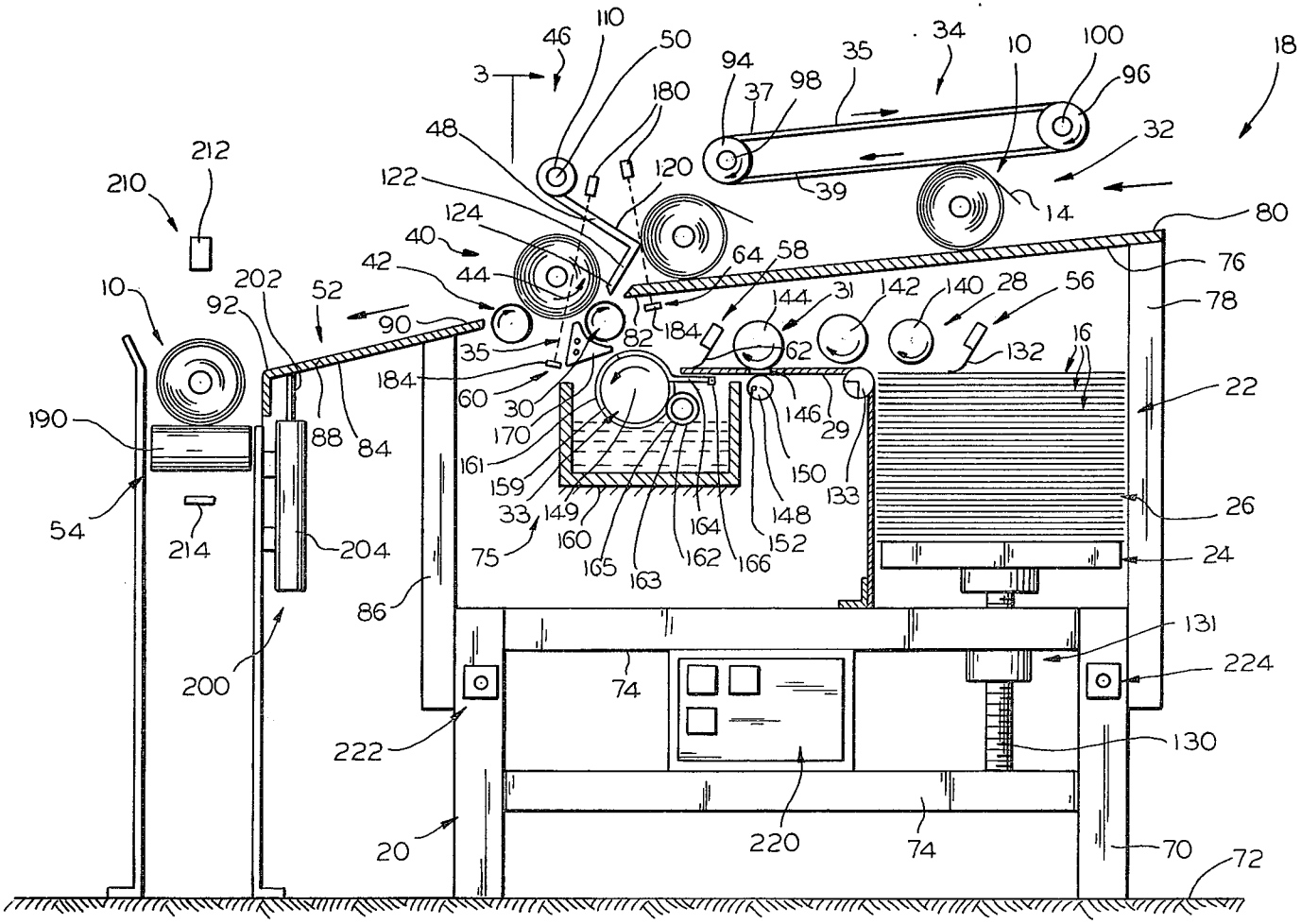
FIG. 1 is a diagrammatic side elevational view illustrating the apparatus arranged in accordance with the present invention.

The frame 20 of the apparatus 18 defines downwardly inclined runway 32, to which the individual rolls 10 are applied one by one, and positioned to extend transversely of the runway 32, with the edge 14 of same free of attachment to the side of the roll, as indicated in FIG. 1, and thus projecting like a flap from the side of the roll.

In this connection it is pointed out that the individual rolls 10, prior to labeling, are formed by suitably convoluting the individual wallpaper sheets involved in such a manner that the decorative surfacing 19 of the sheet faces outwardly of the roll 10. This may be done in any suitable and conventional manner, with or without a core being employed.

In any event, the rolls 10 after being convoluted, for purposes of this invention, need not be secured in convoluted form (as by being taped or the like), in which case the edge 14 will freely project from the individual rolls in the manner indicated in FIG. 1. For purposes of this invention, the rolls are to be oriented with respect to the runway 32 such that their edges 14 are in trailing relation with respect to the individual rolls 10 as they move along the runway 32. The rolls 10 are rolled down the runway 32 by infeed conveyor apparatus 34 in the form of one or more endless conveyor members 35 driven to have their upper and lower runs 37 and 39 moving in the respective directions indicated by the arrows of FIG. 1, with the conveyor appratus 34 being disposed so that the runs 39 of the conveyor members 35 are in frictional engagement with the individual rolls 10, when the latter are to move along runway 32.

The runway 32 leads to a labeling station 40 that is defined by the roller 30 and a companion roller 42 at which the rolls 10 are individually and successively disposed for support thereby during the labeling operation. The roller 30 is constantly driven in the direction indicated by the arrow of FIG. 1 to rotate the individual rolls 10 in the direction indicated by the arrow 44 when a roll 10 is supported by the rollers 30 and 42 for labeling purposes.

The apparatus 18 also includes an ejector mechanism 46 including, in the form illustrated, a pair of kicker arms 48 journaled for rotation about a horizontal axis 50 to move clockwise of FIG. 1 for ejecting a roll 10 that has been labeled from the labeling station 40 onto exit ramp 52 whereby the individual rolls 10 move under gravity onto a carry away conveyor 54 that in the form shown successively moves the individual labeled rolls 10 to a point of packaging and/or storage, etc. as desired.

Operably associated with the apparatus 18 are control switches 56 and 58 for effecting the movement of the individual labels 16 from the stack of labels 20 in timed relation to the rolls 10 moving down the runway 32. Operably associated with the labeling station 40 is a sensing device 60 for sensing the presence of a roll 10 in labeling position at station 40. Switches 56 and 58 and sensing mechanism 60 are incorporated in suitable control circuiting whereby the individual labels 16 are moved by first stage feed mechanism 28 to a ready position in engagement with the feeler arm 62 of control switch 58 where the individual labels dwell until the roll 10 to be labeled has taken its position at the labeling station 40. The individual rolls 10 are moved by the conveyor 34 to a position adjacent the labeling station 40 wherein their presence is sensed by a suitable sensing device 64 which actuates ejector mechanism 46 to swing the throw arms 48 360 degrees and permit the application of the roll 10 in question to the labeling station by moving onto same under gravity from the discharge end of the runway 32. The ejection mechanism returns to its "at ready" position of FIG. 1.

Meanwhile, the presence of the roll 10 to be labeled at the labeling station 40 has been sensed by the sensing device 60 to actuate the feed roll mechanism 31 to feed the label 16, that is at the ready position, across glue roller 33 and thence between guide device 35 and the rotating feed roller 30, which rolls the leading end and succeeding portions of the label in question onto the exterior surface of the roll. The glue roller 33 is part of the skip glue type glue applying device of the type disclosed in my said patent whereby the gluing mechanism may be adjusted or set to apply glue to the full length of the individual labels 16, or to any limited portion or portions of same. For instance, one way of practicing the present invention is to adjust the glue applying device so that the glue is applied only to the leading and trailing ends of the label, whereby, as the leading end of the individual labels 16 is rolled onto the roll 10, the leading end becomes adhered thereto, and the labelling is completed by the label trailing end being rolled onto its leading end in overlapping relation thereto for securement thereto by the glue that has been applied to the trailing end of the label 16.

When the labeling of the roll has been completed, the ejection device 46 is actuated to remove the freshly labeled roll 10 from the labeling station 40, by engagement therewith of the kicker arms 48, which thus lifts the roll in question free of the roller 30 and rolls the roll 10 in question over the roll 42 for movement down exit ramp 52 and onto conveyor 54. The ejection apparatus 46 for this purpose may be actuated by the next succeeding roll being sensed by sensing device 64, or it may be controlled by a suitable timing mechanism that may be seatable to operate after a predetermined time of positioning of the individual rolls 10 at the labeling station 40, in timed relation to the operation of the label feed devices 28 and 31 and the feeding of the rolls 10 down runway 32. The individual rolls 10 are supplied to the runway 32 by hand or the like in the timed sequence accommodating proper functioning of the various parts of the machine that have been referred to.

SPECIFIC DESCRIPTION

The frame 20 of the apparatus 18 in practice may be suitably arranged to accommodate the various mechanisms referred to. As shown, the frame 12 comprises suitable legs 70 resting on support surface 72 and integrated with suitable cross members 74 to provide the basic framing of the apparatus 18 on which is disposed the hopper 22, the elevator or platform 24 supporting the label stack 26 within the hopper 22, and glue coating device 75 that is suitably mounted on the frame 20.

The runway 32 in the form shown is defined by a runway plate 76 suitably supported on frame 20, as by employing suitable uprights 78 with the arrangement being such that the runway plate 76 is downwardly inclined approximately as illustrated. In the form shown the plate 76 is approximately 5° off horizontal positioning and downwardly inclined from the entrance end 80 to the exit end 82 of same.

The exit ramp 52 comprises downwardly inclined plate 84 supported from frame 20 by suitable uprights 86 or the like. In the form shown, the plate 84 defines a planar ramp portion 88 that is inclined downwardly of the horizontal by approximately 15 degrees.

The plates 76 and 84 are spaced apart to accommodate the labeling station 40 between the exit end of the plate 76 and the entry end 90 of rampway forming plate 84. The exit end 92 of the plate 84 is disposed to discharge the individual rolls 10 on conveyor apparatus 54.

The conveyor apparatus 34 as illustrated comprises the endless conveyor members 35, which may be in the form of pulley belts or bands journaled between end pulleys 94 and 96 that are keyed to the respective shafts 98 and 100. In the form shown, shaft 98 is adapted to be driven by suitable motor 102 through speed reducer 104; drive chain 106 suitably coupled to the shaft 98 and rollers 30 and 42 effects movement of members 35 and rollers 30 and 42 at the same surface speed, in the illustrated embodiment. As indicated, endless members 35 are to be driven in the directions indicated by the arrows of FIG. 1 so that the individual rolls 10 will roll counterclockwise in being rolled down runway 32.

It is preferable to arrange for vertical adjustment of the conveyor 34 to accommodate setting of same for application of the invention to convoluted wallpaper or the like of variant diameters and this may be done in any suitable manner. Of course, it is preferable to label at one running of the apparatus 18 all rolls 10 that are of the same diameter. The spacing of the lower runs 9 of the endless members 35 should be such that the rolls 10 are frictionally engaged with them whereby the rolls 10 are rolled as indicated in FIG. 1, and in a controlled manner, toward the labeling station 40.

The ejection apparatus 46 comprises a pair of the kicker members 48 suitably fixed to rotatable shaft 110 that is journaled for rotation about the axis 50 by being suitably mounted in cross framing 112 in which the shafts 98 and 100 may also be conveniently journaled. Shaft 110 in the form shown is rotated by suitable drive motor 114 through suitable clutch 116 operating drive chain 118 that is suitably coupled to the shaft 110.

As indicated in FIG. 1, the kicker members 48 each are of "L" shaped configuration, defining rectilinear leg portion 120 and foot portion 122 that is in right angled relation thereto. The foot portion 122 is proportioned so that its roll engaging end 124 engages the roll 10 that is at the labeling station 40 (and is ready for ejection therefrom) in the lower rearwardly directed quadrant of same, when the ejection device 110 is operated. Preferably, the foot portion 122 is disposed so that when kicker members 48 are swung about axis 50, the undersurface of the foot portions 122 are spaced slightly from the roller 30 and thus the end portion 124 of the foot portion 122 engages the roll 10 to be ejected from station 40 somewhat rearwardly of its point of contact with the roll 30. Movement of the kicker members 48 about the axis 50, as it continues, effects a lifting of the roll 10 off the roller 30 and a rolling of the roll 10 over the roller 42 for rolling under gravity down exit ramp 52.

It is preferable that at least the support roller 30 be continously driven though, as illustrated, both rollers 30 and 42 may be continuously driven.

The elevator platform 24 includes threaded shaft 130 fixed thereto that is preferably associated with a suitable drive mechanism 131 including a nut structure (not shown) that is rotated in any suitable manner to maintain the uppermost label 16 of stack 26 at the desired level relation with label support plate 29 and a fixed separator bar 133, under the control of switch 56 having switch arm 132 engaging the uppermost label for this purpose.

The feed roller device 28 is only diagrammatically illustrated as it may be of any suitable nature, that shown including feed rollers 140 and 142 suitably journaled and rotated in the directions indicated in FIG. 1 for feeding a label 16 from the top of stack 26 across separator bar 133 and label support plate 28 to engagement with the switch arm 62 of control switch 58. Feed roller device 31 comprises an upper constantly rotating roller 144 journaled for operation above a window opening 146 formed in plate 29 under which is operably disposed an eccentrically mounted feed roller 148 that rotates about its own axis 150, which is journaled to be swung about eccentric axis 152 through suitable means that applies the periphery of the roller 148 against the periphery of the roller 144, when the label 16 is to be moved by the feed roller device 31 through the gluer device 75. Again, the feed roller device 31 may be of any suitable type adapted to feed a label 16 that has been disposed at the ready position by feed roller device 28 through the glue coater device 75 for application to the individual rolls 10 through suitable mechanism energized by sensing device 60.

The glue coater device 75 comprises a glue supply pan 160 suitably mounted on frame 20 within which a supply of suitable glue is provided, with glue coating roller 33 being supported for rotation about axis 149 such that the lower portion of the rim of roller 33 will run in the glue contained in pan 160. The roller 33 in particular and the glue coater device 75 in general are preferably arranged substantially in accordance with the corresponding device disclosed in my said U.S. Pat. No. 3,278,359 (the entire disclosure of which is incorporated herein by this reference) and thus is formed to define a periphery having alternating grooves and ridges 159 and 161. Operably associated with the roller 33 is a groove clearing or cleaning roller 162 similarly provided with complementing grooves and ridges 163 and 165 that are intermeshed with the corresponding grooves and ridges of the roller 33 whereby the grooves of roller 33 are cleared from glue as the roller ridges moves upward and toward the glue coating position of the label as it moves across the glue coating roller 33.

Operably associated with the roller 33, following the disclosure of my said U.S. Pat. No. 3,278,359, are a plurality of control fingers 164 that are disposed in each of the grooves of the roller 33 and are mounted on a rock shaft 166 for elevation from a retracted position within the grooves of the roller 33 to a position where they are elevated somewhat above the roller ridges 161 whereby the label that is passing across the glue roller may have portions of same selectively elevated above or out of contact with the glue roller to provide the skip gluing control contemplated by my said patent.

The guide device 35 comprises a series of spaced guide plates 170 shaped to guide the leading edge of the label 16 upwardly around the support roller 30 and into engagement with the rotating roll 10 whereby the leading end of the label, which is to have glue applied thereto, engages the outer surface of the roll 10 in question. As feed of the label 16 on rotation of the roll 10 in question continues, the leading end of the label passes between the roll 10 and roll 30, and the latter thus rolls the label onto the outer periphery of the roll 10, under the weight of the roll 10 resting on the roller 30.

Of course, the roller feed device 31, the glue roller 33, and driving roller 30 are operated so that their peripheries have the same surface rotational speed as the periphery of the rotating roll 10 whereby the label 16 being applied to the roll 10 moves at the surface speed of roll 10.

Rollers 30 and 42 are suitably journaled in the frame 20.

The sensing devices 60 and 64 may be of any suitable type; in the form shown each comprises a suitable light emitting source 180 directing a light beam on photosensitive receiver 182 through labeling station 40. As indicated in FIG. 1, the two basic components of the sensing device 60 are mounted so that the light beam of same passes between the rollers 30 and 42 and is thus interrupted when a roll 10 rolls into the labeling position indicated in FIG. 1. As indicated, the photosensitive device 60 is suitably arranged to actuate the feed roller device 31, and thereby overcome the circuit opening function of switch 58, when a labeled roll 10 is replaced by a roll 10 to be labeled. Device 64 is similarly arranged to actuate ejection device 46, though, alternately, device 46 may be arranged for operator controlled operation using suitable push button control techniques.

Figure 2:
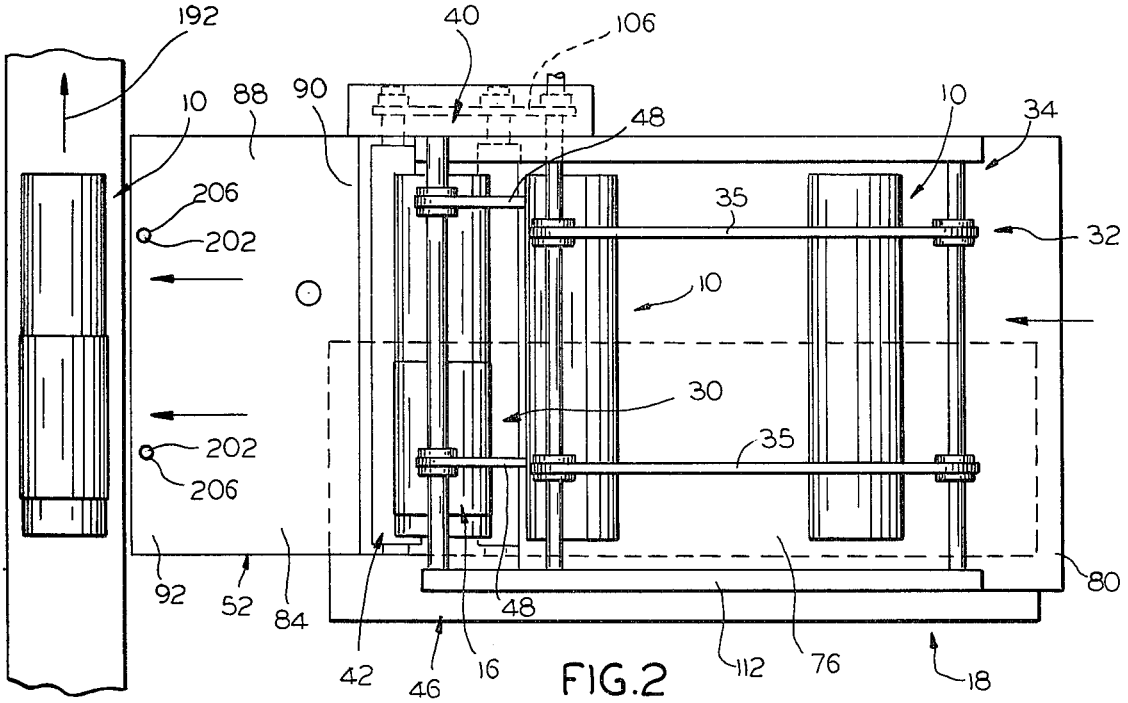
FIG. 2 is a top plan view diagrammatically illustrating the general arrangement of FIG. 1.
Figure 3:
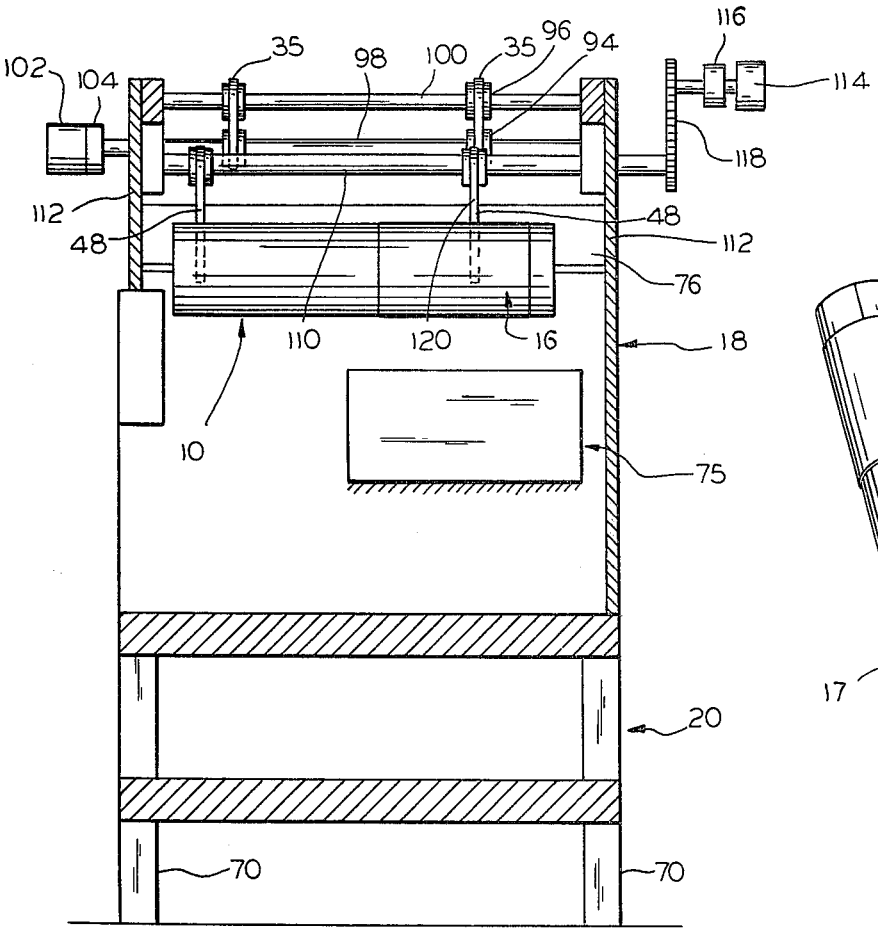
FIG. 3 is a vertical sectional view taken substantially along line 3—3 of FIG. 1.

The conveyor 54 may be of any suitable type, that shown being diagrammatically illustrated as a conveyor belt 190 suitably mounted and operated for conveying freshly labeled rolls 10 in the direction indicated by the arrow 192 of FIG. 2, and thus out of the way of subsequent labeled rolls to be discharged on ramp 52.

Operably associated with the exit ramp 52, in the illustrated embodiment, is a retractable gate device 200 which is diagrammatically illustrated in the form of a pair of upright pin or rod members 202 operably associated with their respective solenoid devices 204 to project upwardly through the respective openings 206 formed in the plate 84 when sensing device 210 senses that a roll 10 has not yet moved out of the ramp unloading position shown in FIG. 2. Sensing device 210 is diagrammatically illustrated as a photosensitive device comprising a suitable source of light 212 directed at photosensitive receiver 214, with the device 210 being suitably connected to the solenoid devices 204 and a suitable source of power whereby the pins or rods 202 are raised, so long as any portion of a roll 10 remains in the unloading position indicated in FIG. 2, whereby the following roll 10 will be retained on the exit ramp 52 until the conveyor 54 operates to move the leading roll 10 out of the way. When the leading roll 10 in question is out of the way, the sensing device 210 acts to cause retraction of the retaining pins or rods 202 to the position of FIG. 1 whereby any roll 10 held on the exit ramp 52 will now discharge onto the conveyor 54.

The apparatus 18 may be provided with suitable control panel 220 to which the operating controls of the various convenient operation by an operator. In the form shown, shut down control buttons 222 and 224 are provided at either end ofthe apparatus 18 for emergency shut down purposes.

It will therefore be seen that the invention provides a method and apparatus for labeling rolls of wallpaper and the like without requiring that the rolls previously have been secured in rolled up relation. As indicated, the individual rolls are rolled down along the runway after being positionally oriented thereto such that their outer free end edges are in trailing relation with respect to the direction of rotation of the individual rolls as they are moved down the runway. The individual rolls are applied to the labeling station where they are rolled in the same direction of rotation and have applied thereto the label that is to both secure the free outer end edge of the roll against the side of the roll and also provide the identifying indicia or the like that are to be applied to the roll. For this purpose, the individual labels are fed lengthwise thereof at the surface speed of the individual rolls as they are being rotated at the labeling station, and the label is rolled onto the roll by one of the rollers that is supporting the wallpaper roll as it is being labeled.

As indicated, the labels are proportioned such that the trailing end of the label will overlap the leading end thereof whereby the trailing end of the label will be glued to the leading end thereof to secure the label in place on the roll. For this purpose the step glue applying apparatus employed in the invention may be operated to apply glue only to the leading and trailing ends of the label, as desired.

The roll is then ejected from the labeling station to roll under gravity down the exit ramp onto the carry away conveyor.

The controls for the various operating components of the apparatus 18 may be suitably arranged to achieve the operational timing desired to effect efficient motivation of the wallpaper rolls through the machine and the feeding of the individual labels thereto and rolling of same thereon, as well as ejection of the individual rolls from the labeling station and application of same to the carry away conveyor.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. Apparatus for labeling a series of convoluted sheet rolls of substantially the same diameter, and of which the outer end edge of the sheet of each roll to be labeled is free of securement against the roll, said apparatus comprising:

a runway having entrance and exit ends and comprising:

a planar support plate extending between said runway ends and forming a roller way along which the rolls are to be consecutively rolled toward said exit end, with the rolls oriented to extend transversely of said runway with the outer end edge of the sheet thereof in trailing relation with respect to the direction of rotational movement of the individual rolls along the runway, as the rolls roll in a forward direction of linear movement along the runway, said plate being downwardly inclined in the direction of said runway exit end, an endless conveyor extending longitudinally of said runway and above said plate and comprising one or more endless conveyor members including means for training said members to define upper and lower conveyor runs, with the lower conveyor runs being disposed above and parallel to said plate, said conveyor lower runs being spaced above said plate for frictionally engaging the upper surfaces of such rolls, as such rolls are applied to said runway with said orientation, and means for driving said conveyor to move said conveyor members such that said lower runs thereof move toward said runway exit end to roll the rolls applied to said runway in said direction of rotational movement along the runway toward said exit end thereof in the forward direction of linear movement, a labeling station adjacent the exit end of said runway through which the individual rolls pass from the runway one by one, said labeling station comprising:

a pair of spaced apart, horizontally disposed, rollers extending transversely of said direction of linear movement, said rollers being spaced apart longitudinally of the runway direction of linear movement to receive and support the individual rolls thereon and therebetween in a labeling position for labeling in sequence one by one as the rolls enter the labeling station, said rollers being coplanar with a horizontal plane disposed at a level adjacent to but below the level of said runway exit end, means for rotating one of said rollers to rotate the individual rolls at a predetermined surface speed when supported by and between said rollers, and in the said direction of rotational movement, a label supply station, means for feeding individual labels one by one from said supply station to said labeing station at said surface speed and into adhering encircling relation to the individual rolls when rotated by said rotating means at said labeling station, an exit ramp adjacent to and downstream of said labeling station, and means for ejecting the labeled rolls one by one from said labeing station onto said ramp, said ejecting means comprising:

a plurality of kicker members mounted for swinging movement about a common horizontal axis disposed above said labeling position and extending normally of said direction of linear movement, said kicker members being spaced apart longitudinally of said axis, said kicker members each comprising a foot element, which elements are positioned relative to said horizontal axis to simultaneously engage a labeled roll adjacent either end thereof when in said labeling position, and said kicker members are swung toward such roll, and means for simultaneously swinging said kicker members 360 degrees about said horizontal axis in a rotational direction opposite the direction of rotational movement of said rolls in being rolled along said runway by said conveyor, for bringing said foot elements from a retracted position into engagement with the respective rolls when at said labeling position, after having been labeled, for ejecting same from said labeling station, and for returning said foot elements to said retracted position while moving same in the same direction of rotational movement, said foot elements projecting in the direction of movement of said kicker members under the action of said swinging means, and being disposed relative to said horizontal axis to have a path of movement thereabout that is adjacent to but spaced above said labeling station rollers, whereby said kicker members on actuation of said swinging means engage a labeled roll when in said labeling position on the rearward underside thereof, with respect to the direction of movement of said rolls along said runway, to effect a lifting of such roll off the roller of said labeling station that is closest said runway exit and roll such roll over the other of said labeling station rollers onto said exit ramp, said horizontal axis being centered between said labeling station rollers, means for actuating said label feeding means when a roll to be labeled has moved from said runway exit end into said labeling position, and means for actuating said ejecting means swing means to eject the labeled roll from said labeling station when the next succeeding roll to be labeled is at a predetermined position adjacent said runway exit end.

2. The apparatus set forth in claim 1 wherein:

said label supply station and said label feeding means are disposed relative to said runway to effect application of the labels to one end only of the rolls.

* * * * *